United States Patent [19]

Lancelot

[11] Patent Number: 4,638,788

[45] Date of Patent: Jan. 27, 1987

[54] DEVICE FOR MOUNTING A GLASS PANE ON AN OVEN DOOR

[75] Inventor: Pierre Lancelot, Gommegnies, France

[73] Assignee: Eurofours, Gommegnies, France

[21] Appl. No.: 683,544

[22] Filed: Dec. 19, 1984

[30] Foreign Application Priority Data

Jan. 17, 1983 [FR] France ..... 84 00684

[51] Int. Cl.[4] ..... F23M 7/00; F24C 15/04

[52] U.S. Cl. ..... 126/198; 126/200; 126/190

[58] Field of Search ..... 126/190, 198, 200; 52/316, 312; 219/391

[56] References Cited

U.S. PATENT DOCUMENTS

| | | | |
|---|---|---|---|
| 2,394,176 | 2/1946 | Hillebrand | 126/200 |
| 3,200,812 | 8/1965 | Larkin | 126/200 |
| 3,453,997 | 7/1969 | Kelpzig | 126/198 |
| 3,561,423 | 2/1971 | Holtkamp | 126/198 |
| 3,659,582 | 5/1972 | Morgan | 126/200 |
| 3,788,300 | 1/1974 | Doner | 126/190 |
| 3,910,254 | 10/1975 | Morgan | 126/198 |
| 4,023,554 | 5/1977 | Katona | 126/200 |
| 4,041,930 | 8/1967 | Katona | 126/198 |
| 4,074,677 | 2/1978 | Lotz | 126/200 |
| 4,214,571 | 7/1980 | Scherer | 126/190 |
| 4,253,286 | 3/1981 | Katona | 126/198 |
| 4,264,800 | 4/1981 | Jahnke et al. | 126/200 |
| 4,290,409 | 9/1981 | Mayo | 126/198 |
| 4,292,488 | 9/1981 | Birk | 126/200 |
| 4,455,479 | 6/1984 | Itoh et al. | 126/200 |

FOREIGN PATENT DOCUMENTS

| | | | |
|---|---|---|---|
| 215635 | 5/1961 | Austria | 126/190 |
| 463269 | 2/1950 | Canada | 126/200 |
| 1125607 | 6/1982 | Canada | 126/200 |
| 2201440 | 1/1984 | France . | |
| 2063463 | 6/1981 | United Kingdom | 126/200 |

*Primary Examiner*—Samuel Scott
*Assistant Examiner*—H. A. Odar
*Attorney, Agent, or Firm*—Blum Kaplan Friedman Silberman & Beran

[57] ABSTRACT

Device for mounting a glass pane on an oven door. The glass pane is situated at some distance from the inside face of the door and is fixed thereon, the inside face of said glass pane cooperating with a joint which surrounds the oven aperture to achieve the closure of the latter. The invention finds an application in the manufacture of ovens.

6 Claims, 3 Drawing Figures

DEVICE FOR MOUNTING A GLASS PANE ON AN OVEN DOOR

The present invention relates to a glass-door system adaptable to various types of ovens, for use in particular in the food industry, for pastry-making for example. The invention is a novel conception and way of mounting the glass in the oven door.

Known systems of oven doors comprise a glass pane fixed on the inside of the door, tightness of said glass being achieved by joints, known as glass pane joints.

Overall tightness of the oven door is achieved by door joints fixed either on the door and facing the oven, or on the oven and facing the door.

Problems inherent in these known systems are problems of leakage at the level of the gaskets, as well as problems of cleaning the glass, and of excessive heating of the door.

The object of the present invention is to overcome these problems by proposing a new device for mounting the glass pane on the oven door.

The glass pane according to the invention is fixed on the inside face of the oven door, without being fastened thereto, via stay rods or any other fastening means (screws, bolts, etc.). Said glass pane is therefore situated at a certain distance from the oven door and is preferably parallel thereto. Therefore, contact between these two elements (door and glass) is only through the stay rods.

In the mounting according to the invention, the glass pane rests, when the door is closed, against a gasket fixed on the oven. The stay rods are situated, with respect to the aperture of the oven, inside or preferably outside the sealing gasket on which the glass rests.

As a result of the mounting according to the invention, the following advantages have been noted:

The glass pane is easier to clean since only its smooth inside requires cleaning.

There is no longer any problems of leakage at the level of the pane gaskets, since these joints are no longer a factor of the assembly according to the invention.

And also, this new mounting has been found to improve considerably the heat insulation of the oven door. An air flow creates, by "stack effect", a certain ventilation by natural convection, between the door and the glass. Heat spreading between these two elements is also considerably reduced since it only occurs via punctual fastening means.

The present invention will be more readily understood on reading the following description, with reference to the accompanying drawings, in which.

Figure 1:
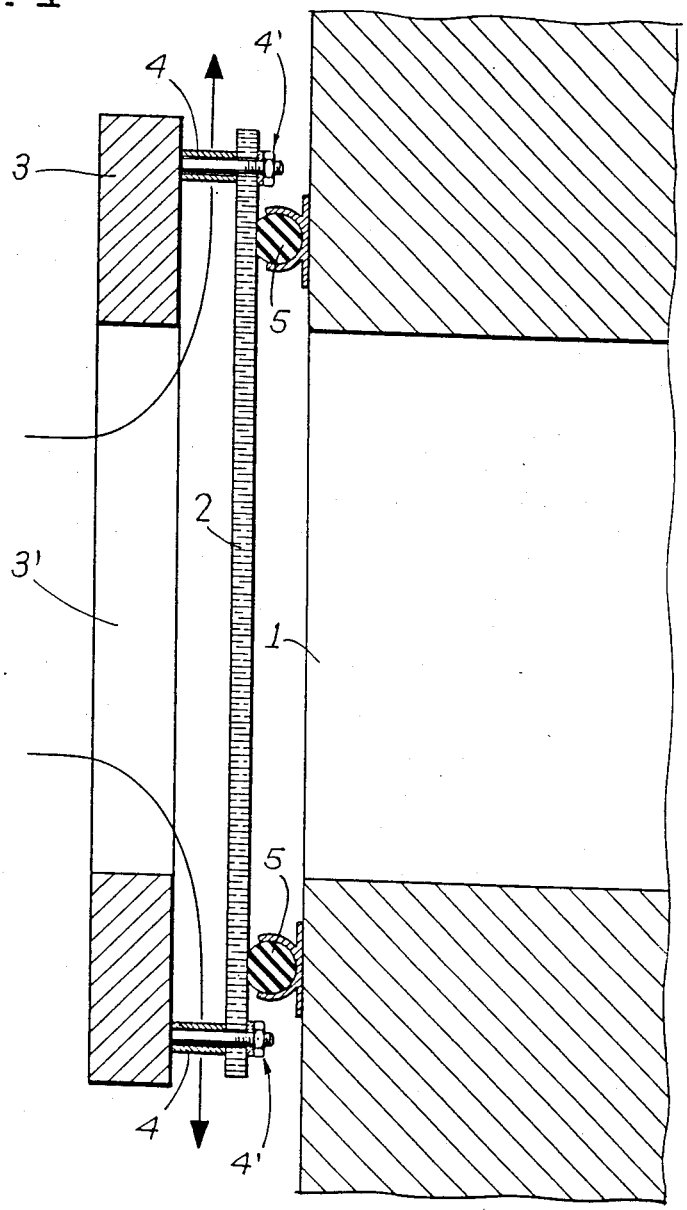
FIG. 1 is a cross-sectional view of an embodiment of an oven door on which a glass pane is mounted according to the invention.

Referring first to FIG. 1, this shows in 1, the oven aperture, in 2, the glass pane, in 3 the metallic door of said oven, also with an aperture 3'.

The glass 2 is secured to the door 3 by means of four stay rods 4, placed at the four corners of the door. Closure of the oven is achieved by means of said glass pane 2 resting on the gasket 5 which is preferably fixed around the aperture 1 of the oven.

Figure 3:
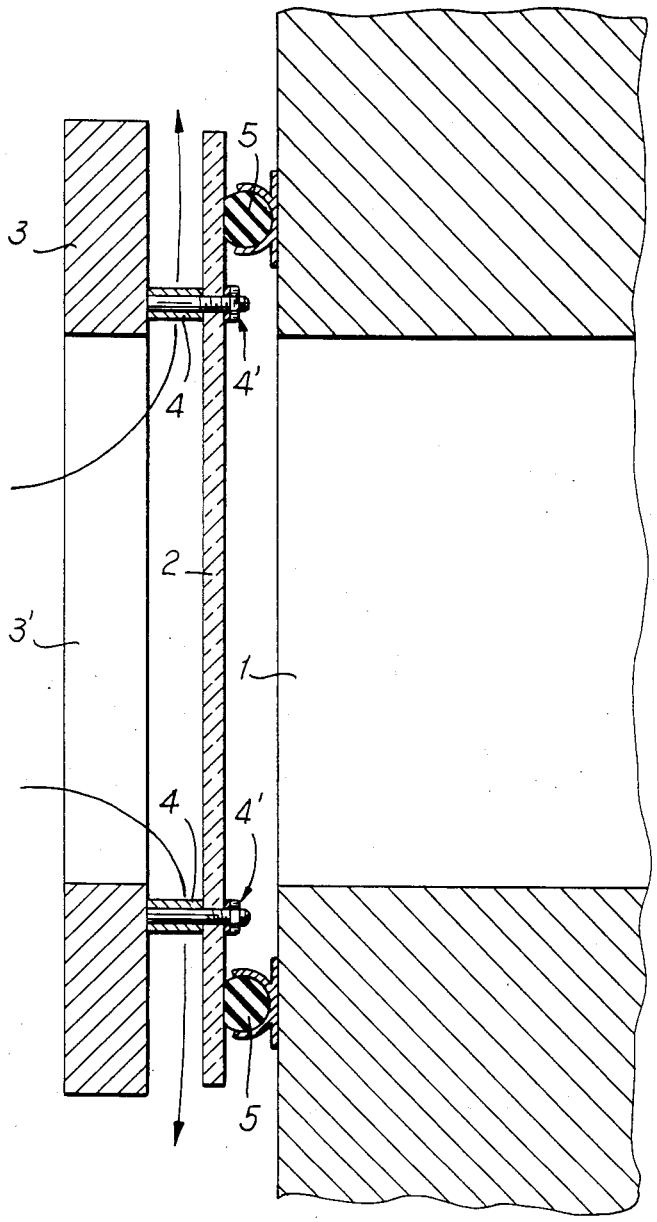
FIG. 3 is a cross sectional view of a further embodiment of an oven door.

Said stay rods 4, inside which is provided a passage used for fastening said glass pane 2 on said door 3 with a screw or bolt means 4', are situated outside the gasket 5 with respect to the aperture of the oven. But as is shown in FIG. 3, said stay rods 4 can also be situated inside the gasket 5 with respect to the aperture of the oven.

The air flow between the door and the glass is illustrated by two long arrows.

Figure 2:
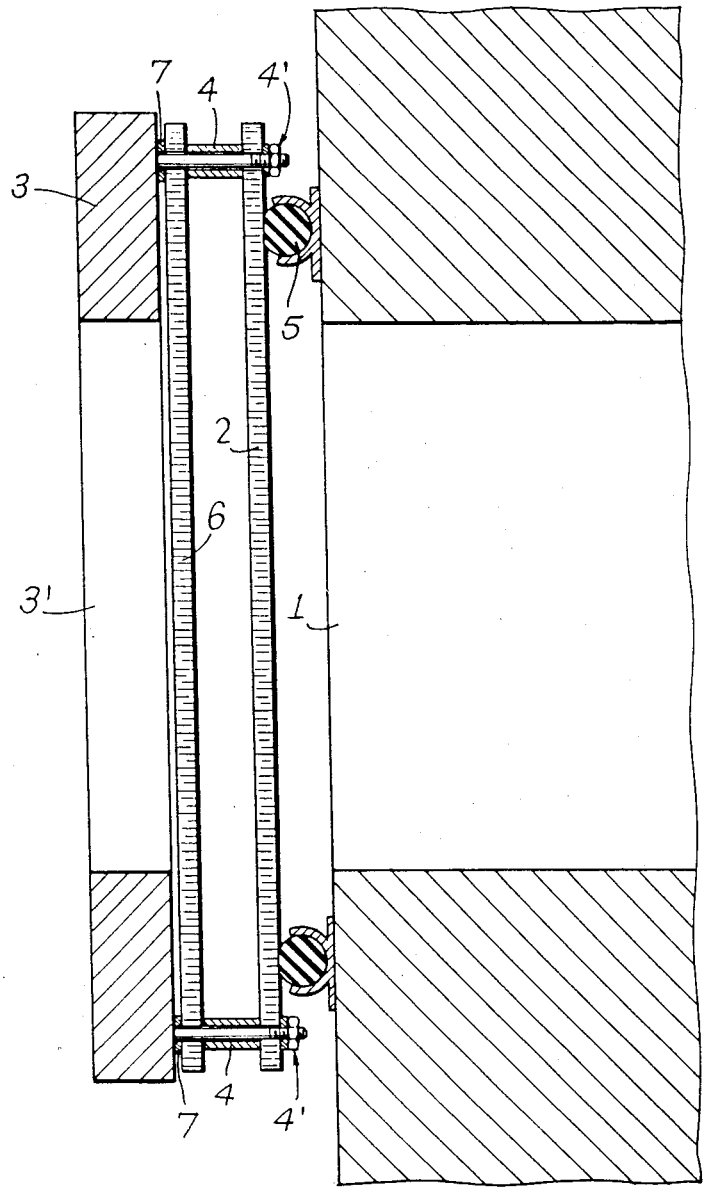
FIG. 2 is a cross-sectional view of another embodiment of oven door with two glass panes.

FIG. 2 shows a door 3 on which is fixed a first glass pane 6 with interposition of a stay rod 7 between the glass and the inside face of the door. A second glass 2 is fixed on screws 4' fast with the door, stay rods 4 being interposed at some distance from the inside face of the door 3 and from the first glass 6. Said second glass 2 cooperates with a gasket 5 which surrounds the aperture of the oven 1 to achieve the closure of the latter.

The first glass 6 is secured close to or against the inside face of the door.

As in the embodiment illustrated in FIG. 1, an air flow is created between glasses 2 and 6.

The invention is in no way limited to the description given hereinabove and on the contrary covers any modification that can be made thereto without departing from its scope.

What I claim is:

1. An oven glass door system comprising in combination an oven including an opening for providing access; a gasket means, said gasket means being secured to said oven about said opening and an oven door, said oven door including at least one transparent panel means having a first face and a second opposed face secured to the oven door in spaced relationship thereto so that said first face of said transparent panel is disposed in facing relationship with the oven door and so that said second face of said transparent panel is disposed in cooperative engagement with said gasket means to form a seal therebetween when said door is in a closed position.

2. The oven glass door system, as claimed in claim 1, wherein said oven door includes an opening therein for permitting air currents to flow therethrough and through the space between said oven door and said transparent panel to permit venting with respect thereto.

3. The oven glass door system, as claimed in claim 2, and including fastening means, said fastening means cooperatively supporting said transparent panel in spaced apart facing relationship with said oven door.

4. The oven glass door system, as claimed in claim 3, wherein the fastening means comprises stay rods having a predetermined length and the distance between said transparent panel means and the oven door is determined by the length of the stay rods, said stay rods being disposed without the seal formed between the gasket means and the transparent panel.

5. The oven glass door system, as claimed in claim 3, wherein the distance between said transparent panel means and said oven door is determined by stayrods of a predetermined length, said stayrods being disposed within the seal formed between the transparent panel means and said gasket means.

6. The oven glass door system, as claimed in claim 1, wherein panel means include two glass panels secured to said oven door, said first glass panel being disposed in facing relationship with said oven door, said second glass panel being disposed in spaced apart relationship with said first glass panel so that said second glass panel is brought into cooperative engagement with said gasket means to form a seal therebetween when said oven door is in a closed position.

* * * * *